US007044924B1

(12) United States Patent
Roth et al.

(10) Patent No.: US 7,044,924 B1
(45) Date of Patent: May 16, 2006

(54) MASSAGE DEVICE

(75) Inventors: Rochelle B. Roth, Shaker Hts., OH (US); Brian Smith, Cleveland Heights, OH (US); William Brazis, Medina, OH (US); Roger H. Ramsey, Akron, OH (US)

(73) Assignee: Midtown Technology, Cleveland, OH (US)

( * ) Notice: Subject to any disclaimer, the term of this patent is extended or adjusted under 35 U.S.C. 154(b) by 519 days.

(21) Appl. No.: 09/586,307

(22) Filed: Jun. 2, 2000

(51) Int. Cl.
*A61H 9/00* (2006.01)

(52) U.S. Cl. ..... 601/151; 601/148; 601/152; 602/13; 2/DIG. 3; 128/DIG. 20

(58) Field of Classification Search ..... 601/151, 601/152, 148–150; 602/13; 128/DIG. 20; 2/DIG. 3
See application file for complete search history.

(56) References Cited

U.S. PATENT DOCUMENTS

| | | | | |
|---|---|---|---|---|
| 1,608,239 | A | 11/1926 | Rosett | |
| 2,361,242 | A | 10/1944 | Rosett | |
| 2,528,843 | A | 11/1950 | Poor | |
| 2,533,504 | A | 12/1950 | Poor | |
| 2,781,041 | A | 2/1957 | Weinberg | |
| 2,880,721 | A | 4/1959 | Corcoran | 128/39 |
| 2,893,382 | A | 7/1959 | Demeny | |
| 3,177,866 | A | 4/1965 | Wesslund | |
| 3,297,023 | A | 1/1967 | Foley | |
| 3,411,496 | A | 11/1968 | Strehler | |
| 3,659,593 | A | 5/1972 | Vall | |
| 3,701,173 | A | 10/1972 | Whitney | |
| 3,824,992 | A | 7/1974 | Nicholson et al. | 128/24 |
| 3,826,249 | A | 7/1974 | Lee et al. | |
| 3,867,732 | A | 2/1975 | Morrell | |
| 3,885,554 | A | 5/1975 | Rockwell, Jr. | |
| 3,888,242 | A | 6/1975 | Harris et al. | 128/64 |
| 3,920,006 | A | 11/1975 | Lapidus | |
| 3,993,053 | A | 11/1976 | Grossan | 128/64 |
| 4,013,069 | A | 3/1977 | Hasty | |
| 4,029,087 | A * | 6/1977 | Dye et al. | 128/24 R |
| 4,030,488 | A | 6/1977 | Hasty | |
| 4,054,129 | A | 10/1977 | Byars et al. | 128/24 |
| 4,156,425 | A | 5/1979 | Arkans | |

(Continued)

FOREIGN PATENT DOCUMENTS

CA 1133347 12/1982

(Continued)

*Primary Examiner*—Stephen K. Cronin
*Assistant Examiner*—Victor K. Hwang
(74) *Attorney, Agent, or Firm*—Hahn, Loeser & Parks, LLP

(57) ABSTRACT

A massage device for massaging a body part of a person in an unsupervised and unattended setting. The massage device includes a garment, shaped to provide a snug fit and having a plurality of bladders arranged along the garment to massage the body part. An inflation assembly supplies fluid pressure to each of the bladders to inflate the respective bladders. The bladders may have approximately the same inflated volume thereby equalizing the inflation volume of the respective bladders whereby substantially even inflation timing, with substantially even applied pressure, and, thus, overall smooth massage dynamics may be provided without overly complicated inflation fluid control (e.g., an inflation assembly which supplies a substantially constant inflation capacity to each of the bladders). The garment may include a pocket having an opening communicating with the respective bladders and tubing from the inflation assembly extends into this pocket. The inflation assembly may provide throttled deflation flow, tapered inflation/deflation patterns, and/or a zone selector which allows a user to select a certain zone of the garment.

32 Claims, 8 Drawing Sheets

U.S. PATENT DOCUMENTS 4,198,961 A * 4/1980 Arkans ..... 601/152
4,202,325 A 5/1980 Villari et al.
4,207,875 A 6/1980 Arkans
4,207,876 A 6/1980 Annis
4,225,989 A 10/1980 Corbett et al.
4,231,355 A 11/1980 Hara ..... 128/24.2
4,253,449 A 3/1981 Arkans et al.
4,267,611 A 5/1981 Agulnick ..... 5/453
4,280,485 A 7/1981 Arkans
4,311,135 A 1/1982 Bruckner et al.
4,374,518 A 2/1983 Villanueva
4,453,538 A 6/1984 Whitney
4,551,874 A 11/1985 Matsumura et al. ..... 5/453
4,573,453 A * 3/1986 Tissot ..... 601/152
4,577,626 A 3/1986 Marukawa et al.
4,583,255 A 4/1986 Mogaki et al. ..... 5/453
4,590,925 A 5/1986 Dillon
4,597,384 A * 7/1986 Whitney ..... 601/152
4,622,706 A 11/1986 Takeuchi ..... 5/453
4,624,244 A 11/1986 Taheri
4,722,332 A 2/1988 Saggers
4,762,121 A 8/1988 Shienfeld ..... 128/64
4,809,684 A 3/1989 Gardner et al. ..... 128/64
4,846,160 A 7/1989 Gardner et al. ..... 128/64
4,865,020 A 9/1989 Bullard ..... 128/64
4,938,208 A 7/1990 Dye
4,941,458 A * 7/1990 Taheri ..... 128/64
4,989,589 A 2/1991 Pekanmaki et al. ..... 128/64
5,007,411 A 4/1991 Dye
5,014,681 A 5/1991 Heeman et al. ..... 128/64
5,022,387 A 6/1991 Hasty ..... 128/64
5,031,604 A 7/1991 Dye
5,052,377 A 10/1991 Frajdenrajch ..... 128/64
5,092,317 A 3/1992 Zelikovski ..... 128/64
5,109,832 A 5/1992 Proctor et al. ..... 128/24
5,117,812 A * 6/1992 McWhorter ..... 601/149
5,179,941 A 1/1993 Siemssen et al. ..... 128/40
5,211,162 A 5/1993 Gillen, Jr. et al. ..... 128/64
5,233,974 A 8/1993 Senoue et al. ..... 128/64
5,245,990 A 9/1993 Bertinin ..... 128/64
5,263,473 A * 11/1993 McWhorter ..... 601/27
5,307,791 A 5/1994 Senoue et al. ..... 601/9
5,329,640 A 7/1994 Hourigan
5,342,285 A 8/1994 Dye
5,383,842 A 1/1995 Bertini ..... 601/151
5,396,896 A 3/1995 Tumey et al. ..... 128/690
5,403,265 A 4/1995 Berguer et al. ..... 601/151
5,435,009 A 7/1995 Schild et al.
5,575,762 A 11/1996 Peeler et al. ..... 601/152
5,584,798 A 12/1996 Fox
5,588,954 A 12/1996 Ribando et al.
5,611,772 A 3/1997 Fujimoto et al.
5,626,556 A * 5/1997 Tobler ..... 601/151
5,672,148 A 9/1997 Maunier ..... 601/148
5,725,485 A 3/1998 Ribando et al.
5,762,618 A 6/1998 Yamanaka et al. ..... 601/148
5,769,800 A * 6/1998 Gelfand et al. ..... 601/151
5,792,082 A 8/1998 Yamanaka et al. ..... 601/148
5,795,312 A 8/1998 Dye
5,843,007 A * 12/1998 McEwen et al. ..... 601/152
5,876,359 A 3/1999 Bock et al.
5,938,627 A 8/1999 Hickman
5,938,628 A 8/1999 Oguri et al.
6,080,120 A * 6/2000 Sandman et al. ..... 601/152
6,123,681 A * 9/2000 Brown, III ..... 602/75
6,129,688 A 10/2000 Arkans
6,155,996 A 12/2000 Van Brunt et al.
6,159,172 A 12/2000 Gray et al.
6,171,270 B1 1/2001 Gau
6,179,796 B1 1/2001 Waldridge
6,179,797 B1 1/2001 Brotz
6,203,510 B1 3/2001 Takeuchi et al.
6,231,532 B1 5/2001 Watson et al.
6,254,556 B1 7/2001 Hansen et al.
6,267,739 B1 7/2001 Cengarle
6,273,866 B1 8/2001 Thomas et al.
6,290,662 B1 9/2001 Morris et al.
6,296,617 B1 10/2001 Peeler et al.
6,447,467 B1 * 9/2002 Barak ..... 601/149

FOREIGN PATENT DOCUMENTS

| | | |
|---|---|---|
| CA | 2070031 | 12/1992 |
| DE | 1903217 | 4/1970 |
| EP | 0026799 | 4/1981 |
| EP | 0129481 | 12/1984 |
| EP | 0392670 | 10/1990 |
| EP | 0392689 | 10/1990 |
| EP | 0542383 | 5/1993 |
| FR | 2267751 | 12/1975 |
| FR | 2371914 | 7/1978 |
| FR | 2511241 | 2/1983 |
| FR | 2583978 | 1/1987 |
| GB | 483111 | 4/1938 |
| GB | 1531268 | 11/1978 |
| GB | 2068737 | 8/1981 |
| SU | 839534 | 6/1981 |
| SU | 1412784 | 7/1988 |

* cited by examiner 300
302
200
250l
250k
250j
250i
250h
250g
250f
250e
250d
250c
250b
250a
304
310

250a
250b
250c
PRESSURE
TIME 250a
250b
250c
PRESSURE
TIME 250a
250b
250c
PRESSURE
TIME

MASSAGE DEVICE

FIELD OF THE INVENTION

This invention relates generally as indicated to a massage device and more particularly to a massage device for use in an unsupervised and unattended setting.

BACKGROUND OF THE INVENTION

A massage has long been recognized as a pleasant means of treating stress, muscular aches, fatigue and other symptoms associated with an active life. A professional masseuse is typically employed to provide a massage and this professional is trained to provide pressure sensations by squeezing or kneading muscles or muscle groups in a certain way. Also, a professional masseuse will adapt the massaging technique to the person being massaged. For example, the masseuse will vary the time, intensity (i.e., pressure level), the order of pressure sensations and/or the temperature of massage oil to accommodate a person's massage needs on a particular day. Furthermore, the hands of the masseuse are adaptable to fit almost every size person.

A massage applied by a professional masseuse is almost universally considered wonderful. However, the cost of having a professional masseuse constantly on call for periodic massages is outside most people's budgets. For many, a massage by a professional masseuse is only an occasional indulgence although our active lives justify more frequent massages.

In the past, massaging devices have been developed for relaxation and leisure purposes. These massaging devices generally function in a vibratory manner to create a vibrating sensation on various muscles of the body. However, these vibratory devices are generally not as satisfying as a human massage because, among other reasons, they do not provide a comparable amount of pressure, and they often create an undesired tingling sensation on the user's skin.

Also in the past, compression devices have been developed for medical purposes. These prior art compression devices are generally used in a hospital setting where trained medical personnel are available to insure proper functioning of the device and a proper fit of the garments/sleeves on the patient. Such prior art compression devices use very large inflatable bladders which cover large areas of a limb, their control units are large and cumbersome, and they operate to provide a very slow massaging action (for example, on the order of tens of seconds to inflate each bladder) and thus do not provide a dynamic massaging effect. Additionally or alternatively, in such a medical setting, it may be practical to have an inventory of sleeves/garments of different sizes to accommodate a variety of patient sizes. Further, the size and appearance of inflation tubing and/or the complexity of the set-up of such tubing does not present any issues in a medical setting, where a trained medical professional is present or available. As for the inflation assembly, complicated and expensive fluid-providing and/or distributing components are common place in these prior art medical devices.

The inventor of the present invention appreciated that a relatively simple, inexpensive massage device intended for relaxation and other personal, non-medical uses in an unsupervised and unattended setting (such as in-home use) could have many advantages and applications. The inventor further appreciated, however, that many of the features of prior art compression devices which are acceptable in a supervised medical setting, would not be satisfactory in such an unsupervised and unattended setting.

SUMMARY OF THE INVENTION

The present invention provides a massage device for massaging a body part of a person in an unsupervised and unattended setting. The massage device comprises a garment for enclosing the body part, the garment having a plurality of bladders arranged along the garment to massage the body part, and an inflation assembly which supplies fluid pressure to each of the bladders to inflate the respective bladders.

The garment may be made of two opposing sheets with seams between the sheets defining the bladders. The sheets may be made of a material which is lightweight, durable and easily cleanable, such as urethane film. For example, the outer sheet may be urethane film supported on a laminate and the inner sheet may be unsupported urethane film.

The inflation assembly may include fluid-providing components, fluid-distributing components, control components, protection components, a display panel, and a power supply. These components of the inflation assembly may be contained within a housing which is sized and shaped to be compatible with unsupervised and unattended use of the massage device. The fluid-providing components could include a compressor, the fluid-distributing components could include a manifold and valves, and the control components could include a micro-controller, a user input interface, and valve drivers. In such a design, the compressor would provide a flow of inflation fluid to the manifold, the drivers would open/close the valves (e.g., activate/deactivate solenoid valves) so that the fluid within the manifold flows through the appropriate valve and to the appropriate bladder in the garment. The drivers could be controlled by the micro-controller based on input through the user input interface.

According to one embodiment of the invention, the garment has a "one-size-fits-most" design extremely beneficial for use of the massage device in an unsupervised and unattended setting. To this end, the garment may be shaped to accommodate the lower leg portion of the user's body with an opening for receipt of the user's heel. In this case, the garment could have, for example, four bladders which massage the user's foot and eight bladders which massage the user's calf, for a total of twelve bladders. In order to provide a snug fit to the user, the sheets may include a notch on each lateral separating the bottom bladders from the top bladders whereby the garment may provide a snug fit to user. Additionally or alternatively, the garment includes a loop fastening strip and a complimentary hook fastening strip which, when engaged with each other, form a hook-and-loop attachment. The loop fastening strip could be secured to the inner sheet and the hook fastening strip could be secured to the outer sheet. The loop fastening strips may be secured to the inner sheet laterally inward from pull handles and over and laterally beyond a tubing pocket and the hook fastening strip may be secured to the outer sheet adjacent its longitudinal edge.

In this manner, the garment can be fit to a range of foot widths and leg girths to accommodate users of different sizes and a very broad range of adjustment combinations are possible with the garment instead of simply a large, medium and small adjustment settings. The ability of the garment to provide a snug custom fit to a user results in improved sensation, quicker inflation dynamics, reduced inflation flow requirements (thereby decreasing pump/valve/tubing sizing and minimizing air flow requirements), compacted time lag from a deflated state to a maximum pressure state, and increased time at maximum massage pressure. The snug custom fit of the garment also reduces the inflated size of the bladders thereby maintaining the proper fit of the garment throughout the inflation process.

According to another embodiment of the invention, the bladders have approximately the same inflated volume thereby equalizing the inflation volume of the respective bladders. In this manner, substantially even inflation timing, with substantially even applied pressure, and, thus, overall smooth massage dynamics may be provided without overly complicated inflation fluid control. Approximately uniform inflated volumes are accomplished by necking seams in at least some of the bladders and the decreased volume in the necked bladder(s) is accomplished without decreasing the sensation of the necked bladder(s). For example, the necked shape of each of the bladders does not substantially change the original, overall, shape of the unnecked bladder (e.g., rectangular) so that substantially the same massage sensation is delivered. If the garment is shaped to accommodate the lower leg portion of the user's body, the top bladders circumscribing the user's calf could be necked and the bottom bladders circumscribing the user's foot could be unnecked.

According to another embodiment of the invention, the garment may include a pocket having an opening communicating with the respective bladders and wherein the inflation assembly including a source of inflation fluid and tubing extending from this source into the pocket. The enclosure of the tubing in the pocket provides a "clean appearance" compatible with in-home use of the massage device. Also, the enclosure and the pre-purchase setup of the tubing eliminates any what-tube-where confusion during in-home use of the massage device.

According to another embodiment of the invention, the inflation fluid may flow through throttled exhaust lines during deflation of the bladders. The throttling rate may be the same or may vary between respective bladders. Additionally or alternatively, the inflation assembly may include a zone selector which allows a user to select a certain zone of the garment thereby allowing concentration on a particular zone of the user's body. The zones may be preset of may be user-defined. If the garment is shaped to accommodate the lower leg portion of the user's body, for example, the bottom bladders that massage the user's foot could be grouped as a first foot zone and the top bladders that massage the user's calf could be grouped in a second lower calf zone and a third upper calf zone.

These and other features of the invention are fully described and particularly pointed out in the claims. The following descriptive annexed drawings set forth in detail certain illustrative embodiments of the invention, these embodiments being indicative of but a few of the various ways in which the principles of the invention may be employed.

DRAWINGS

DETAILED DESCRIPTION

Figure 1:
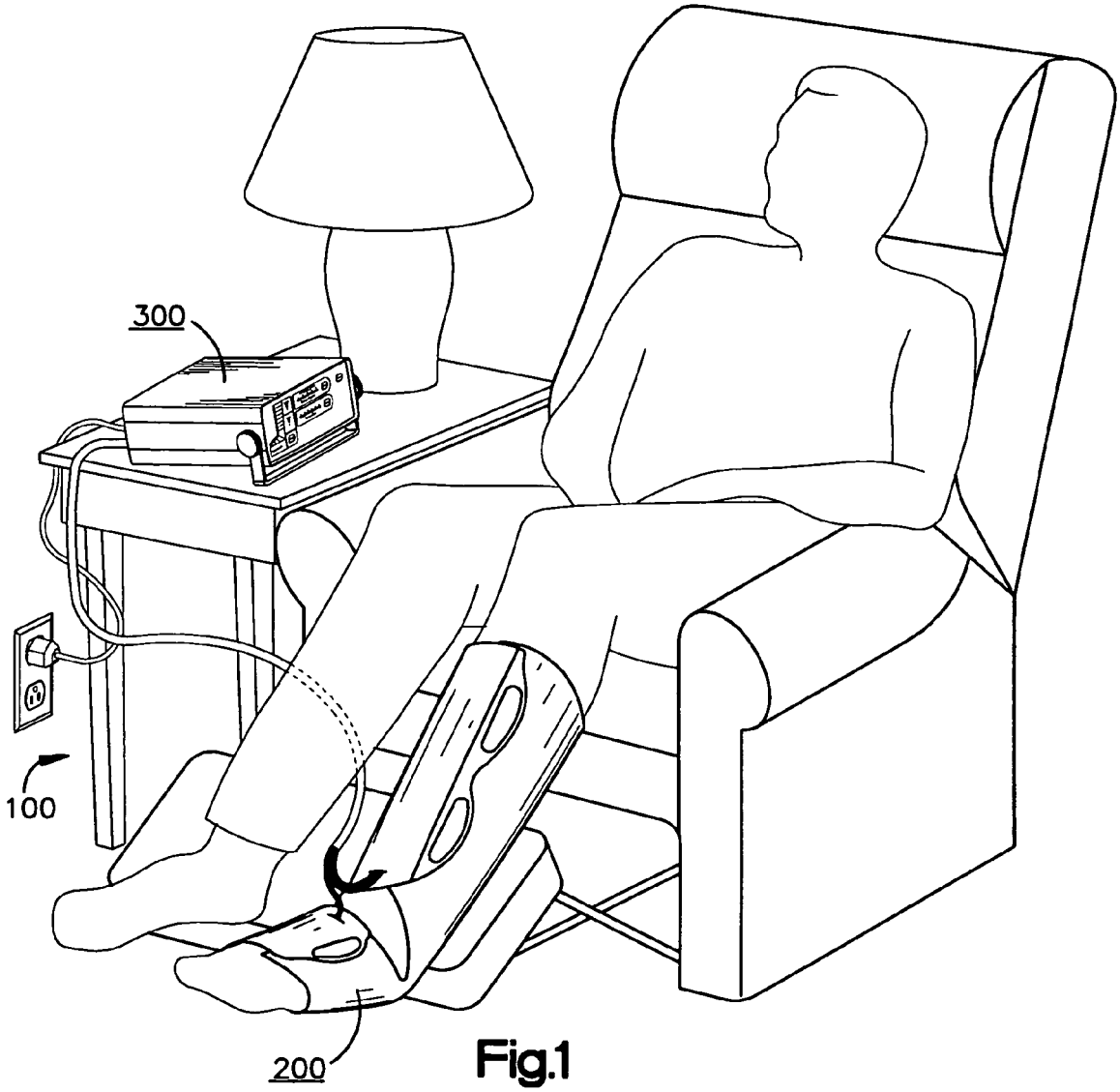
FIG. 1 is a prospective view of a massage device according to the present invention being used in an unsupervised and unattended setting, the massage device including a garment and an inflation assembly.

Referring now to the drawings, and initially to FIG. 1, a massage device 100 according to the present invention is shown in use in an unsupervised and unattended setting. The massage device includes a garment 200 for enclosing a body part and an inflation assembly 300 which supplies fluid pressure to the garment 200.

Figure 2A:
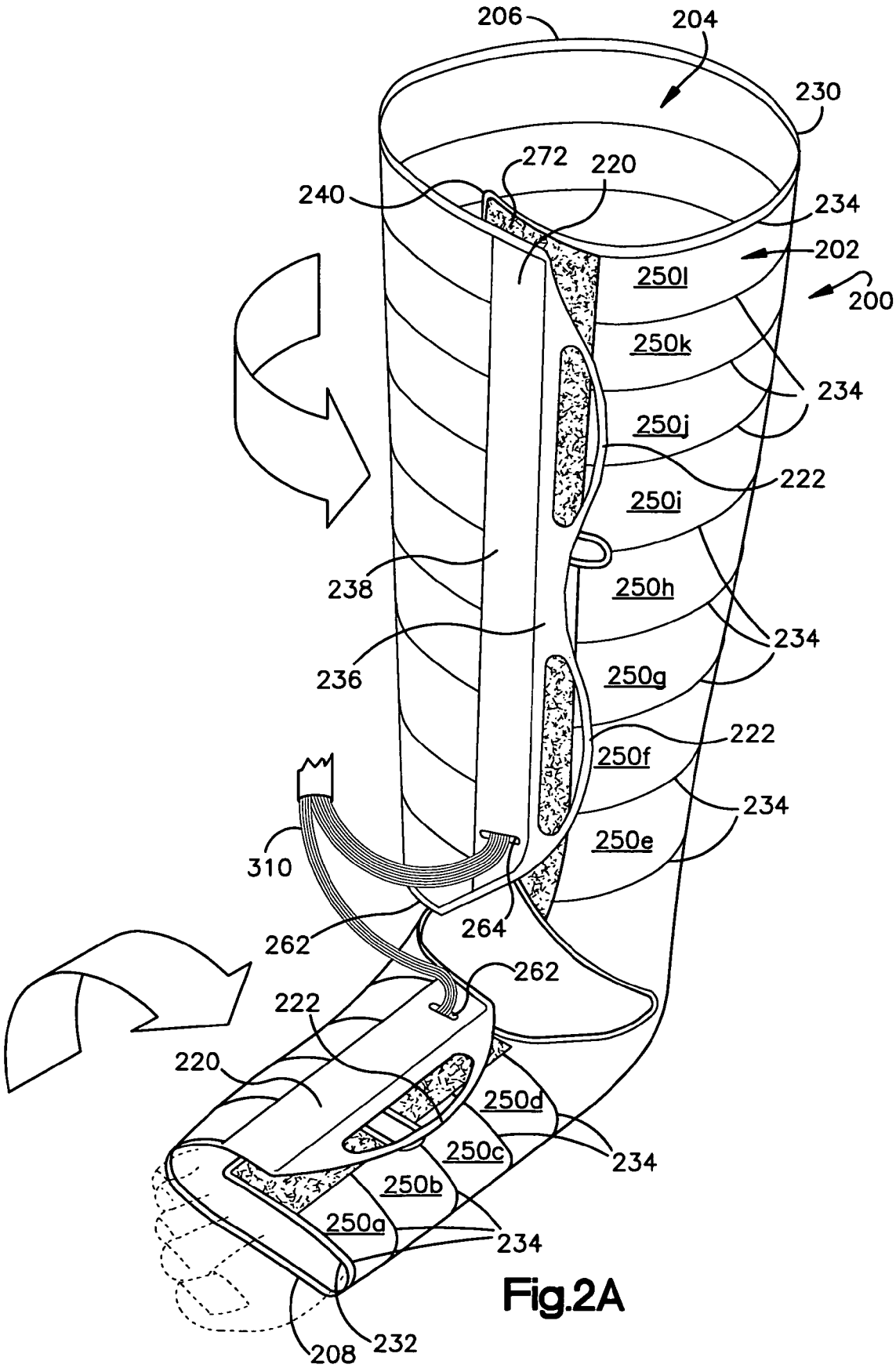
FIG. 2A is a prospective view of the garment in a wrapped condition, the garment including an outer sheet and an inner sheet.
Figure 2B:
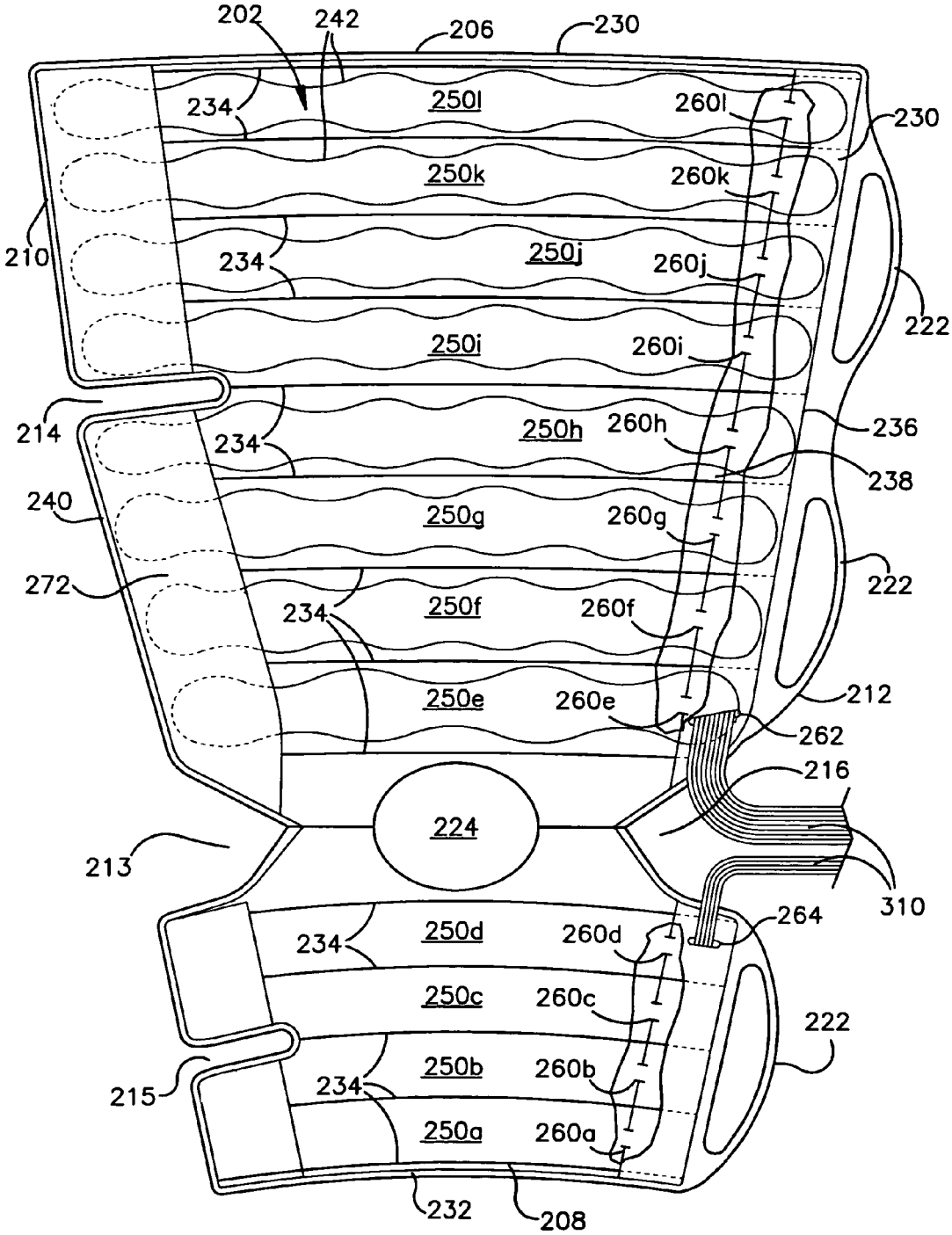
FIG. 2B is a plan view of the garment in an unwrapped condition with its outer sheet face up.
Figure 2C:
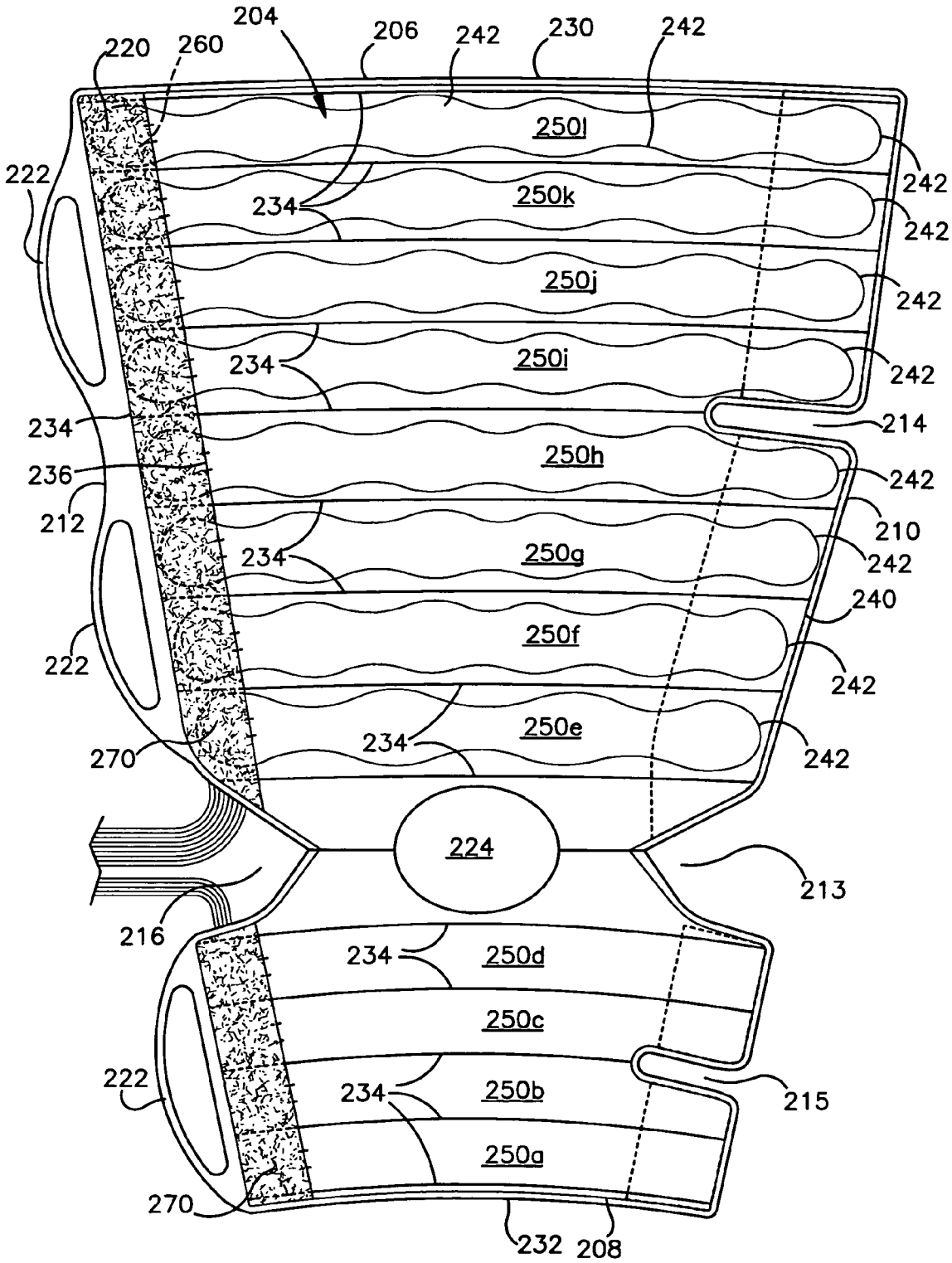
FIG. 2C is a plan view of the garment in an unwrapped condition with its inner sheet face up.

Referring to FIGS. 2A–2C, the garment 200 is shown isolated from the other components of the massage device 100. The garment 200 comprises two opposing sheets 202 and 204 made of a suitable material, such as a material which is lightweight, durable, and easily cleanable with water and a mild cleanser. For example, the outer sheet 202 may be made of urethane film Page 8 supported with a laminate of 70×100 denier nylon weave and the inner sheet 204 may be made of unsupported urethane film.

Each of the sheets 202/204 has lateral edges 206 and 208 and longitudinal edges 210 and 212. The lateral edges, or top and bottom edges, 206 and 208 follow a generally straight or slightly curved path. The longitudinal edge 210 follows a generally linear path except for a V-shaped notch 213 and two U-shaped notches 214 and 215. The longitudinal edge 212 follows a contoured path to form an extension including a tubing pocket 220 and pull handles 222 and has a corresponding V-shaped notch 216. The sheets 202 and 204 each have a roughly rectangular shape with an aligned opening to form a heel opening 224 in the garment 200.

The sheets 202 and 204 are welded together along lateral seams 230, 232 and 234 and longitudinal seams 236, 238 and 240. One of the lateral seams 230 is positioned along the sheets' top lateral edge 206 and another of the lateral seams 232 is positioned along the sheets' bottom lateral edge 208. The remaining lateral seams 234 (twelve in the illustrated embodiment) are positioned in an approximately parallel series throughout the length of the sheets 202/204. Longitudinal seam 236 is positioned laterally inward from the sheets' longitudinal edge 212, longitudinal seam 238 is positioned laterally inward from the seam 236, and longitudinal seam 240 is positioned along the sheets' longitudinal edge 210. Necking seams 242 are also provided for inflation-control reasons explained below. Although not specifically shown in the drawings, reinforcement seams may be provided around the opening-defining edges of the pull handles 222, around the defining edges of the heel opening 224, around the defining edges of V-shaped notches 213 and 216, and/or around the defining edges of U-shaped notches 214 and 215.

The lateral seams 230, 232 and 234 and the longitudinal seams 238 and 240 form a plurality of inflatable bladders 250. In the illustrated embodiment, the garment 200 includes twelve inflatable bladders 250A–250L which are roughly rectangular in shape and arranged longitudinally along the length of the garment 200. The position of the bladders 250A–250C corresponds to the foot location, the position of the bladder 250D corresponds to the heel location, and the position of the bladders 250E–250L corresponds to the lower leg location.

As indicated above, the bladders 250 are each roughly rectangular in shape. The bladders 250 are more particularly shaped so that they each have an approximately equal inflated volume. This may be accomplished by varying the spacing of the seams 234 and/or by the necking seams 242 which decrease the inflation volume of certain bladders. In the illustrated embodiment, the top eight bladders 250E–250L are provided with necking seams 242. By equalizing the inflation volume of the respective bladders 250, substantially even inflation timing, with substantially even applied pressure, and, thus, overall smooth massage dynamics are provided without the need for overly complicated inflation fluid control.

Significantly, the decreased volume in the necked bladders 250E–250L is accomplished without decreasing the sensation of a particular bladder. For example, the necked shape of each of the bladders does not substantially change the original, overall, shape of the unnecked bladder so that substantially the same massage sensation is delivered. In the illustrated embodiment, the necked bladders 250E–250L still maintain a generally rectangular inflation chamber so that substantially the same massage sensation is delivered.

The longitudinal seams 236 and 238 form the longitudinal sides of the manifold pocket 220 and the lateral seams 230 and 232 close the pocket's top and bottom sides. A series of openings 260 in the pocket 220 communicate with the respective bladders 250. The V-shaped slit 216 interrupts the pocket 220 at a location aligned with the seam 234 separating the bladders 250D and 250E.

As was indicated above, the pocket 220 houses certain components of the inflation assembly 300, namely tubing 310, introduced below. The openings 260 allow the tubing to communicate with the bladders 250 and the slots 262 and 264 provides an entry passage for the tubing 310 into the top and bottom portions of the pocket 220. Although not specifically shown in the drawings, the tubing may be connected to the bladders via an inflation "port", such as a push-on barb for the tubing attachment.

The garment 200 additionally includes a fastening strip 270 and a complimentary fastening strip 272 which, when engaged with each other, form a hook-and-loop attachment. The "loop" fastening strip 270 is secured to the inner sheet 204 laterally inward from the pull handles 222 and over and laterally beyond the manifold pocket 220. The "hook" fastening strip 272 is secured to the outer sheet 202 adjacent its longitudinal edge 210.

When the using the massage device 100, the garment 200 is wrapped around the person's leg. Specifically, the person places his/her heel in the opening 224 and wraps the opposite lateral sections of the sheets 202/204 in the direction shown by the arrows in FIG. 2A. The pull handles 222 are then used to pull the strips 270 and 272 into the correct engaging contact with each other for a snug fit. To remove the garment 200 after a massage session is completed, the pull handles 222 are pulled outward to release the hook-and-loop attachment of the fastening strips 270 and 272.

The overall sheet geometry, the positioning of the fastening strips 270 and 272, the lateral extent of the fastening strips and/or other features of the garment 200 allow for a custom fit of the garment 200 to the user. Specifically, for example, the garment 200 can be fit to a range of foot widths and leg girths to accommodate users of different sizes. A very broad range of adjustment combinations are possible with the garment 200 instead of simply a large, medium and small adjustment settings. Thus, the garment 200 has a "one-size-fits-most" design extremely beneficial for use of the massage device 100 in an unsupervised and unattended setting. The ability of the garment 200 to provide a snug custom fit to a user results in improved sensation, quicker inflation dynamics, reduced inflation flow requirements (thereby decreasing pump/valve/tubing sizing and minimizing air flow requirements), compacted time lag from a deflated state to a maximum pressure state, and increased time at maximum massage pressure.

The snug custom fit of the garment 200 reduces the inflated size of the bladders 250 thereby maintaining the proper fit of the garment throughout the inflation process. By virtue of this snug fit, the bladders 250 do not "balloon" away from limb in a third dimension during inflation. In this manner, there is little or no longitudinal "shrinking" of the garment (which would occur if the garment material had to move outward from the limb during inflation) hence maintaining a proper fit during the entire massage.

The garment 200 may include other or further features to facilitate comfort and/or massage characteristics. For example, padding may be provided on the inner surface of the manifold pocket 220 as a cushion between the inflation components housed in the pocket and the user's leg and foot. Additionally, non-slip grid elements may be placed on the outer sheet 202 on the portion of the garment 200 which is positioned beneath the user's foot. Further, various sized holes may be punched through both inner and outer sheet 202/204, between any adjacent seams 234 or 242 to allow for ventilation. Still further, a moisture-wicking lining material may be applied to the surface of the inner sheet 204 for comfort.

It should be noted at this point that although the illustrated garment 200 is designed for use on a person's foot and leg, alternate garments are possible with, and contemplated by, the present invention. For example, the garment 200 may be designed in a similar manner to provide a snug custom-fit for other body parts, such as an arm (upper and/or lower with or without hand), hand only, thigh, foot only, neck and shoulders, and/or back. Additionally, garments may be used in alike combinations, for example both hands together, or in different combinations, for example, leg and thigh together.

Figure 3A:
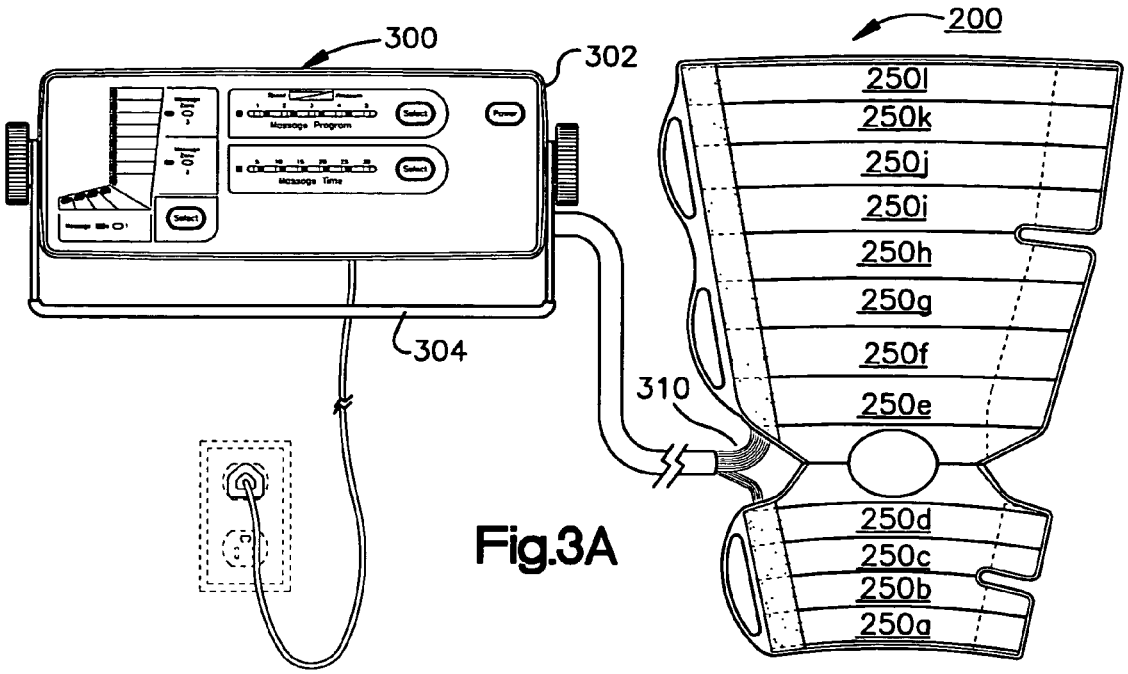
FIG. 3A is a schematic view of the garment and inflation assembly of the massage device.

Referring now additionally to FIG. 3A, the inflation assembly 300 is shown connected to the garment 200. The components of the inflation assembly 300 are contained within a housing 302 which is sized and shaped to be compatible with in-home use of the massage device 100. In the illustrated embodiment, the housing 302 is rectangular in shape, is approximately ten inches wide, nine inches deep, and four inches high, and a handle 304 is provided to selectively prop the housing 302 at a desired angle on, for example, an end table positioned adjacent to a chair.

Connection tubes 310 extend from the inflation assembly 300 to the garment 200 and, more particularly, to the bladder openings 260*a*-260*l*. As is best seen by referring additionally to FIGS. 2B and 3B, the tubes 310*a*–310*d* extend into the lower portion of the pocket 220 and the tubes 310*e*-310*l* extend into the upper portion of the pocket 220. The enclosure of the connection tubes 310 in such a pocket 220, provides a "clean appearance" compatible with in-home use of the massage device 100. Also, the enclosure and the pre-purchase setup of the tubing 310 eliminates any what-tube-where confusion during in-home use of the massage device 100.

Figure 3B:
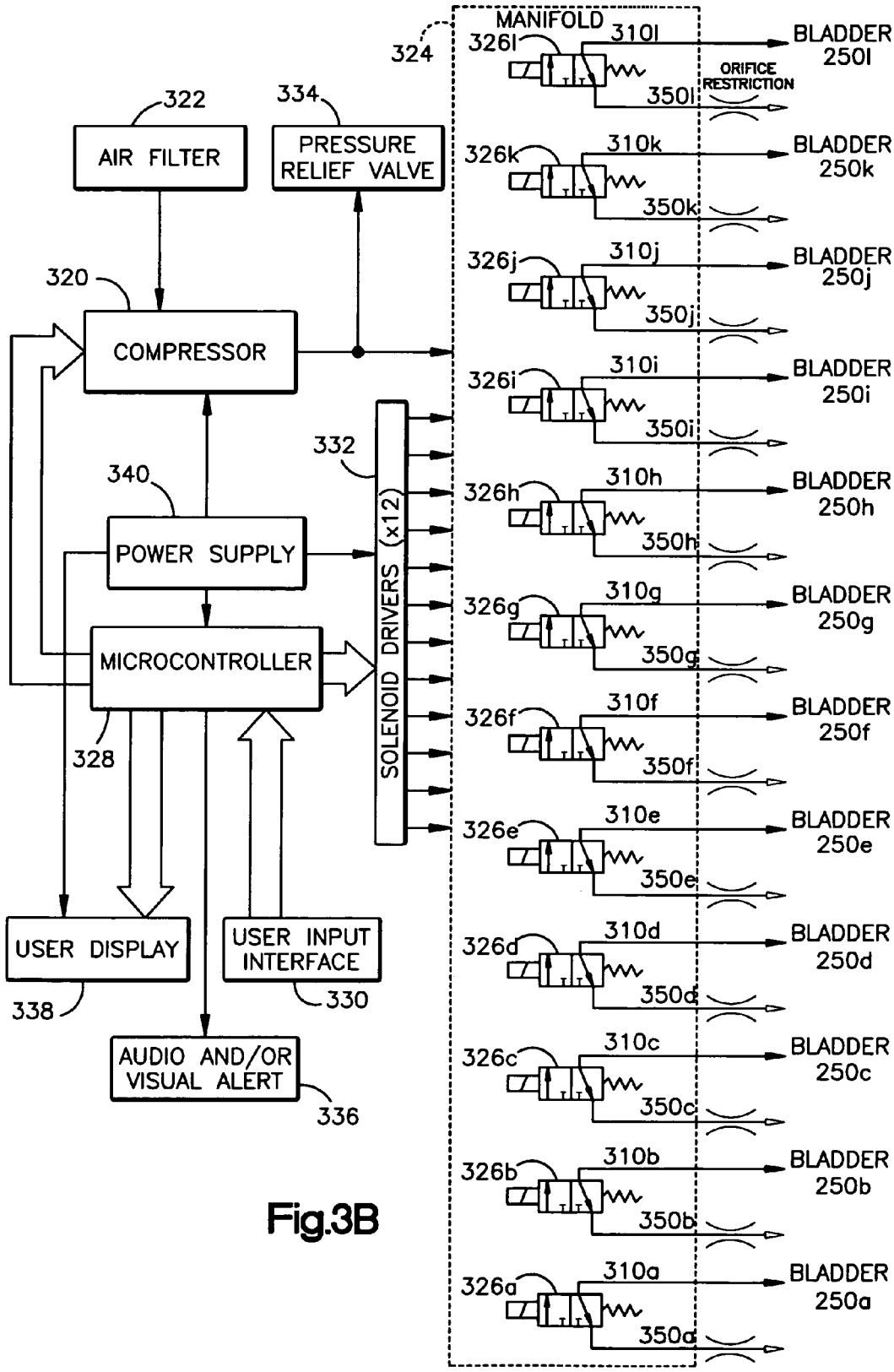
FIG. 3B is a schematic view of the components of the inflation assembly.
Figure 3C:
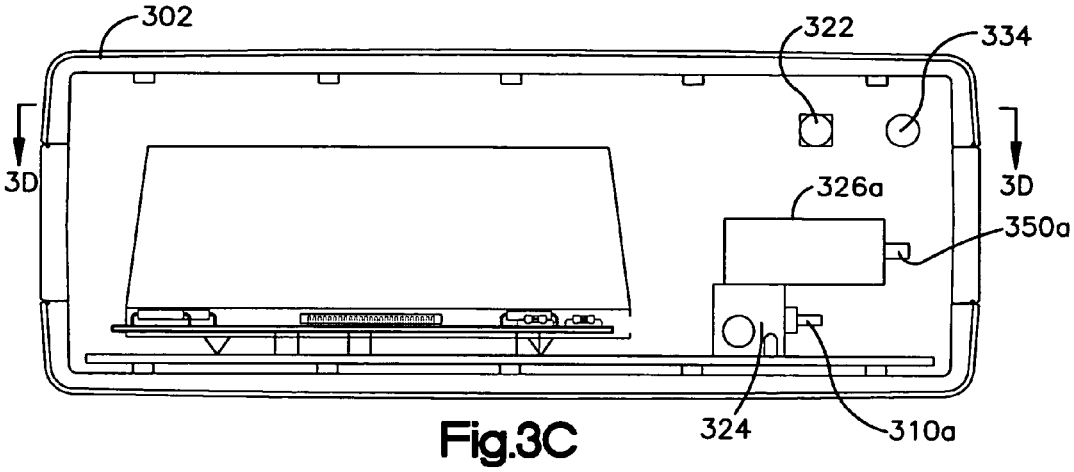
FIG. 3C is a top view of the inflation assembly with the top wall of its housing removed to show interior components.
Figure 3D:
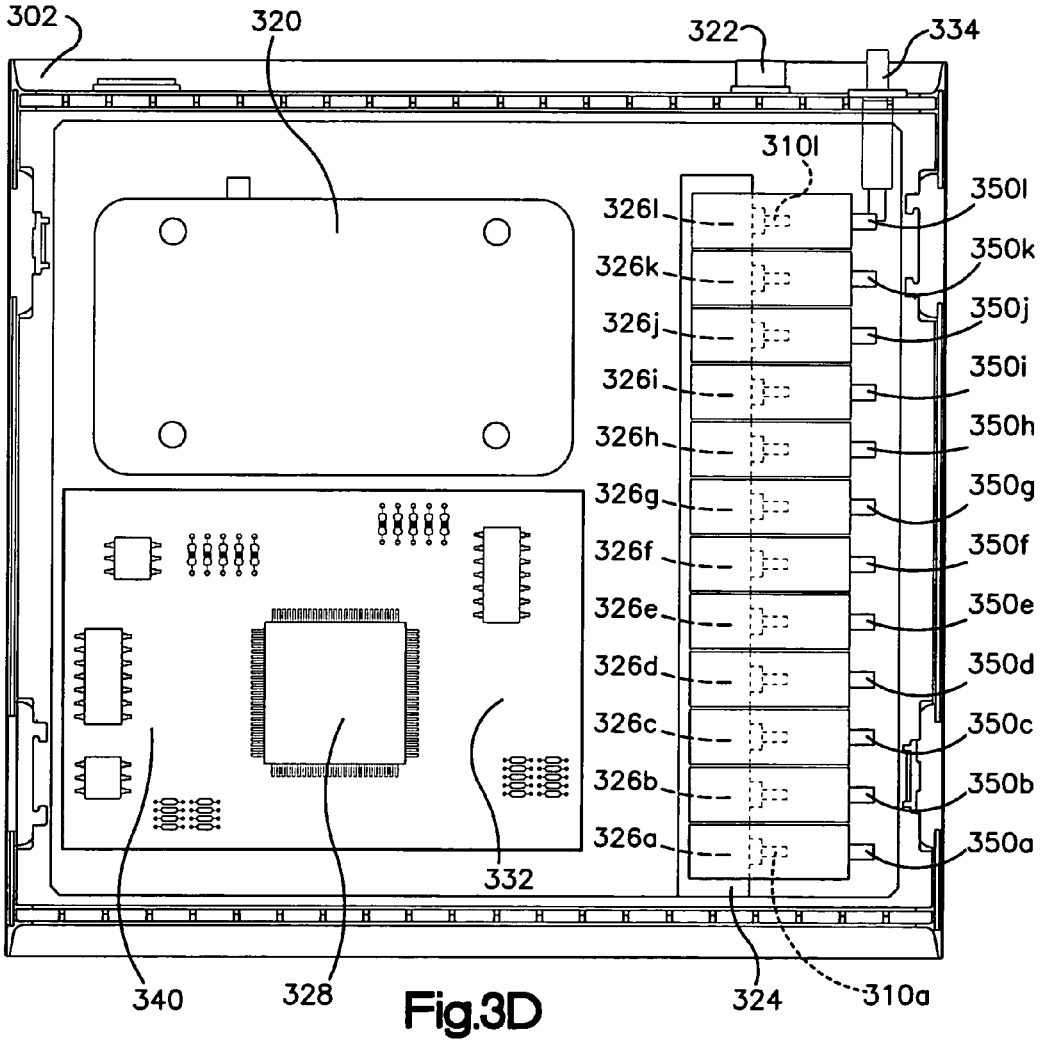
FIG. 3D is a front view of the inflation assembly with its front display panel removed to show interior components.

As is shown schematically in FIG. 3B and/or in FIGS. 3C and 3D, the inflation assembly 300 incorporates the fluid-providing components (a compressor 320, and an air filter 322 when air is used as the pressurizing medium), fluid-distributing components (a manifold 324, valves 326*a*–326*l*) control components (micro-controller 328, user input interface 330, valve drivers 332), protection components (pressure relief valve 334, audio and/or visual alert 336), a display panel 338, and a power supply 340 for providing power to relevant components.

During operation of the massage device 100, the compressor 320 provides a flow of inflation fluid (air filtered through the filter 322) to the manifold 324. The valve drivers 332 open/close the valves 326 so that the fluid within the manifold flows through the appropriate valve and to the appropriate bladder 250 in the garment 200. In the illustrated embodiment, the valves 326 are solenoid valves whereby the drivers 332 are solenoid drivers which activate/deactivate the solenoids.

The compressor 320 of the inflation assembly 300 may be one which provides a substantially constant inflation capacity to each of the bladders. As was explained above, a substantially constant velocity and magnitude pressure wave along the garment 200 is accomplished by varying the geometry of the bladders 250. By providing uniform inflation characteristics of the bladders 250 with a substantially constant inflation capacity, a more uniform, repeatable, predictable, and satisfying massage action can be obtained. Further, more economical, more compact, and/or more reliable inflation components, such as compressors and valves, may be used.

During inflation of the garment bladders 250, inflation fluid flows through the tubing 310 to the appropriate bladder 250. During deflation of the garment bladders 250, the inflation fluid flows through the tubing in the reverse direction and through exhaust lines 350. In the illustrated embodiment, the exhaust lines 350 include a throttling device (such as the illustrated orifice restriction) to provide a repeatable and gradual deflation rate for the bladders. If necessary for uniformity, the throttling rate (or orifice size in the illustrated embodiment) may vary between respective bladders.

Figure 4A:
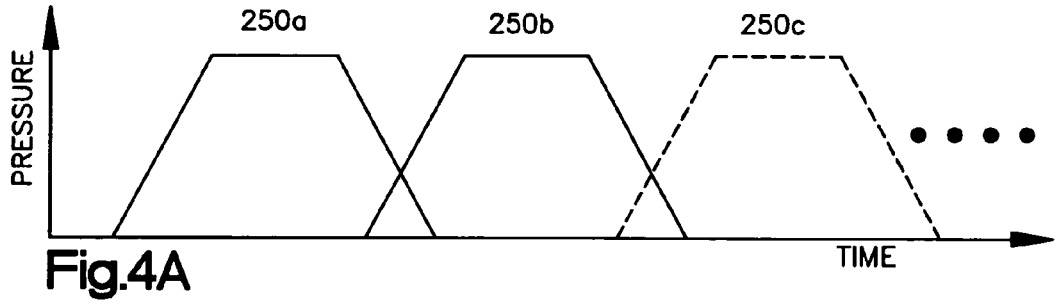
FIG. 4A is a graph showing the sequential inflation of garment bladders according to one inflation pattern.
Figure 4B:
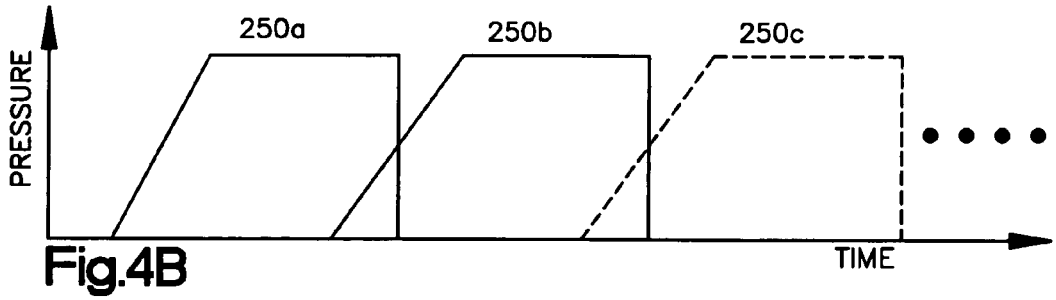
FIG. 4B is a graph showing the sequential inflation of garment bladders according to another inflation pattern.
Figure 4C:
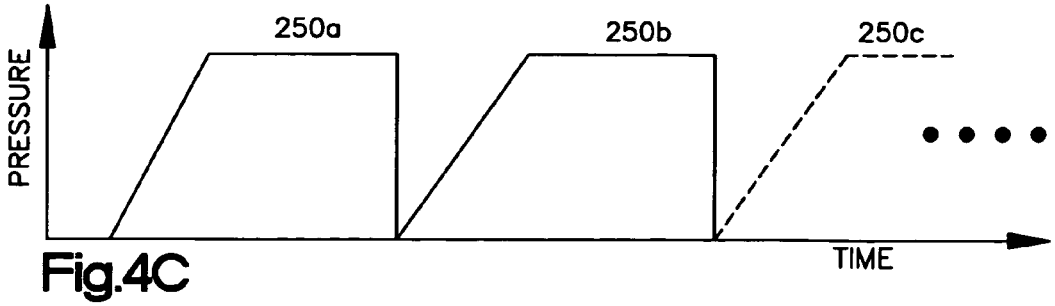
FIG. 4C is a graph showing the sequential inflation of garment bladders according to another inflation pattern.

The solenoid drivers 332 are controlled by the microcontroller 328 based on input through the user input interface 330. The microcontroller 328 may be programmed to inflate the garment bladders 250 in such a manner that there is smooth transition from one bladder to the next during the massage process. For example, the deflation of the first bladder 250A may be throttled so that the inflation of the next bladder 250B is underway prior to complete deflation of the first bladder. (FIG. 4A.) The same effect may be accomplished without a throttled deflation, but the inflation of the next bladder must begin earlier in the timing sequence. (FIG. 4B.) Alternatively, the inflation of the next bladder may be delayed until the previous bladder is completely deflated. (FIG. 4C.)

Figure 3E:
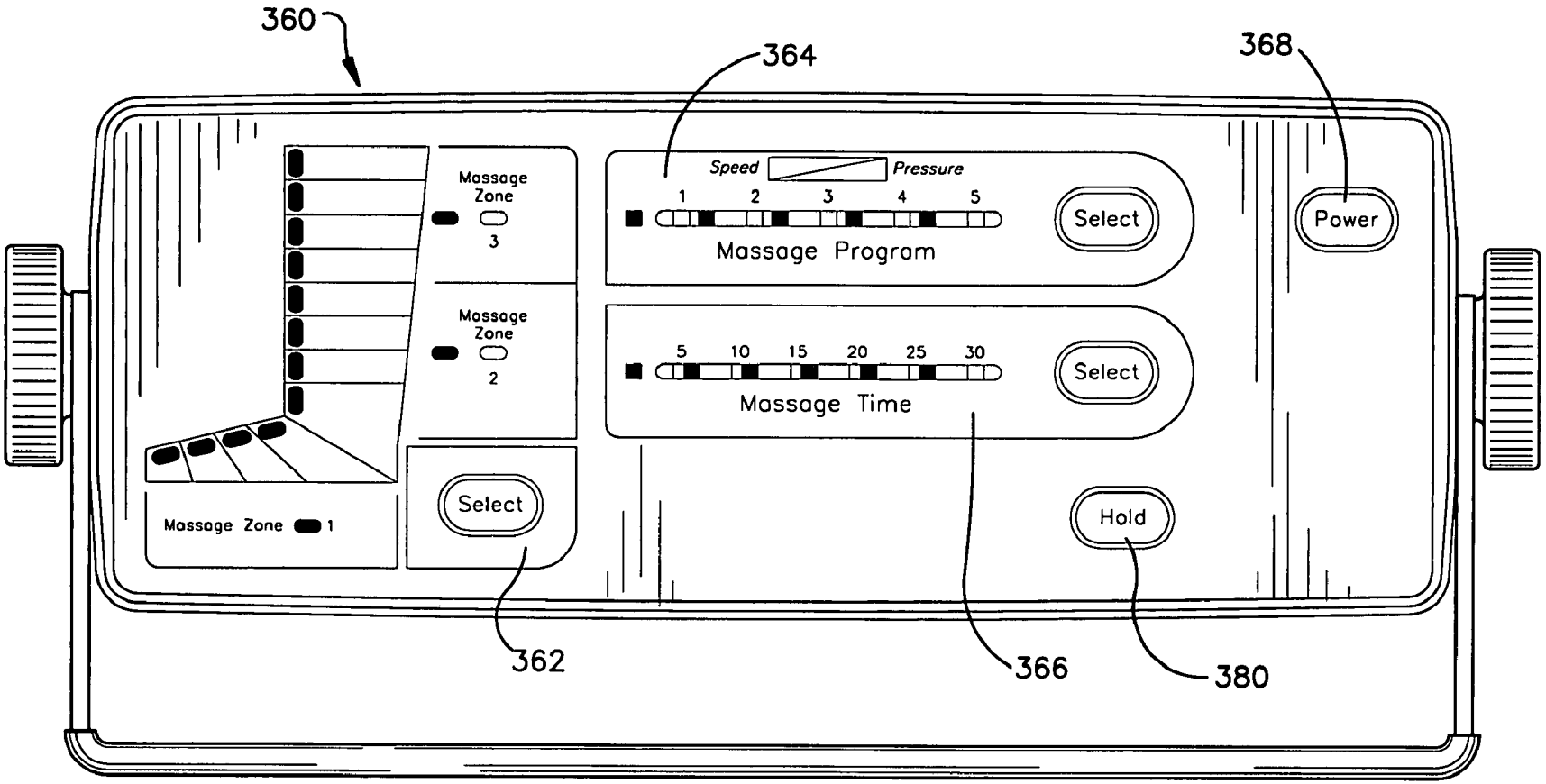
FIG. 3E is an enlarged front view of the front display panel of the inflation assembly.

As shown in FIG. 3E, the user input interface 330 and the user display 338 are incorporated into a display panel 360. The display panel 360 includes a zone selector 362 which, via the user input interface 330, allows a user to select a certain zone of the garment 200. This zone selection allows concentration on a particular zone of the user's body, such as the foot, the lower calf, or the upper calf. In the illustrated embodiment, for example, the garment bladders 250A–250D are grouped in a first "foot" massage zone, the garment bladders 250E–250H are grouped in a second "lower calf" massage zone, and the garment bladders 250I–250L are grouped in a third "upper calf" massage zone. Thus, illustrated display panel 360 allows the user to select the desired preset massage zone. However, an inflation assembly 300 wherein user-definable zones may be input (such as a middle calf zone) are possible with, and contemplated by, the present invention.

The display panel 360 additionally includes an intensity selector 364, a time selector 366, and a power switch 368. The intensity selector 364 allows a user to input a setting in the range of the interrelation between speed and pressure and this input is provided, via the interface 330, to the micro-controller 328 to appropriately control the solenoid drivers 332. With a substantially constant capacity inflation assembly 300, there is an inverse relationship between pressure within the massage pressure wave. Specifically, the faster the massage pressure wave travels the lower the applied pressure within the massage pressure wave and vice versa. The pressure relief valve 334 limits the maximum pressure that can be developed and therefore delivered to the garment 200. To this end, the valve 334 should be inaccessible to the user and tamper proof.

The time selector 366 allows a user to choose a time period for the massage session and this input is provided, the interface 330, to the micro-controller 328. This selector 366 includes an uppermost setting (thirty minutes in the illustrated embodiment) to prevent over use of the massage device 100. Upon completion of the massage session, the audio and/or visual alert 336 alerts the user of the end of the massage session. The power switch 368 activates or deactivates the power supply 340.

The display panel 360 or other suitable component of the massage device 100 may include a "hold" input 380 which, upon activation by the user, provides continuous pressure (or continuous pulsating pressure) in a selected garment chamber or chambers thereby providing concentrated action on a particularly tense portion of the body.

One may further appreciate that although the invention has been shown and described with respect to a certain preferred embodiment, obvious and/or equivalent alterations and modifications will occur to others skilled in the art upon the reading and understanding of this specification. The present invention includes all equivalent alterations and modifications and is limited only by the scope of the following claims.

The invention claimed is:

1. A massage device for massaging a body part of a person in an unsupervised and unattended setting, said massage device comprising:

a garment for enclosing the body part, the garment having a plurality of bladders arranged along the garment to massage the body part, each of said bladders substantially encircling a portion of the body part; and an inflation assembly which supplies fluid pressure to each of the bladders to inflate the respective bladders;

wherein each of the bladders has approximately the same inflated volume thereby equalizing the inflation volume of the respective bladders whereby substantially even inflation timing, with substantially even applied pressure, and, thus, overall smooth massage dynamics may be provided without overly complicated inflation fluid control, and wherein at least two of the bladders have different lengths.

2. A massage device as set forth in claim 1, wherein the garment is made of two opposing sheets and wherein seams between the sheets define the bladders.

3. A massage device as set forth in claim 2, wherein the garment comprises two opposing sheets made of a material which is lightweight, durable and easily cleanable.

4. A massage device as set forth in claim 3, wherein the sheets are made of urethane film.

5. A massage device as set forth in claim 4, wherein the outer sheet is urethane film supported on a laminate and wherein the inner sheet is unsupported urethane film.

6. A massage device as set forth in claim 1, where the garment is shaped to accommodate the lower leg portion of a user, wherein the garment comprises sheets with seams therebetween to define the bladders and where the sheets have an opening for receipt of the user's heel.

7. A massage device as set forth in claim 1, wherein the garment is shaped to accommodate the lower leg portion of the user's body, wherein bottom bladders massage the user's foot and top bladders massage the user's calf, and wherein the sheets include a notch on each lateral side separating the bottom bladders from the top bladders.

8. A massage device as set forth in claim 1, wherein the garment includes a pocket having opening communicating with the respective bladders and wherein the inflation assembly including a source of inflation fluid and tubing extending from this source into the pocket.

9. A massage device as set forth in claim 8, wherein the garment is shaped to accommodate the lower leg portion of the user's body, wherein bottom bladders massage the user's foot and top bladders massage the user's calf, wherein the sheets include a notch on each lateral side separating the bottom bladders from the top bladders, and wherein the pocket includes slots adjacent the notch to provide an entry passage for the tubing into the top and bottom portions of the pocket.

10. A massage device as set forth in claim 1, wherein the garment includes a loop fastening strip and a complimentary hook fastening strip which, when engaged with each other, form a hook-and-loop attachment.

11. A massage device as set forth in claim 10, wherein the loop fastening strip is secured to an inner sheet and the hook fastening strip is secured to an outer sheet.

12. A massage device as set forth in claim 11, wherein the loop fastening strips is secured to the inner sheet laterally inward from pulls handles and over and laterally beyond a tubing pocket and wherein the hook fastening strip is secured to the outer sheet adjacent its longitudinal edge.

13. A massage device for massaging a body part of a person in an unsupervised and unattended setting, said massage device comprising:

a garment for enclosing the body part, the garment having a plurality of bladders arranged along the garment to massage the body part, each of said bladders substantially encircling a portion of the body part; and an inflation assembly which supplies fluid pressure to each of the bladders to inflate the respective bladders;

wherein the garment includes a pocket along substantially the entire length of at least one lateral side of the garment having an opening communicating with the respective bladders and wherein the inflation assembly including a source of inflation fluid and a plurality of tubes extending from this source into the pocket, and wherein, at least two of the bladders have different lengths, but have approximately the same volume.

14. A massage device for massaging a body part of a person in an unsupervised and unattended setting, said massage device comprising:

a garment for enclosing the body part, the garment having a plurality of bladders arranged along the garment to massage the body part, each of said bladders substantially encircling a portion of the body part; and an inflation assembly which selectively inflates and deflates the bladders;

wherein, during deflation of the bladders, the inflation fluid flows through exhaust lines and wherein at least some of the exhaust lines include a throttling device, at least two of the bladders have different lengths, but have approximately the same volume.

15. A massage device for massaging a body part of a person in an unsupervised and unattended setting, said massage device comprising:

a garment for enclosing the body part, the garment having a plurality of bladders arranged along the garment to massage the body part, each of said bladders substantially encircling a portion of the body part when in use; and an inflation assembly which supplies fluid pressure to each of the bladders to inflate the respective bladders; wherein, at least two of the bladders have different lengths but have substantially the same volume, and wherein at least one side of the longer bladder is provided with a necking seam to substantially equalize the bladder volumes.

16. A massage device as set forth in claim 15, wherein the necked shape of each of the bladders does not substantially change the original, overall, shape of the unnecked bladder so that substantially the same massage sensation is delivered.

17. A massage device as set forth in claim 16, wherein the necked shape and unnecked shape of the bladders is substantially rectangular.

18. A massage device as set forth in claim 16, wherein the garment is shaped to accommodate the lower leg portion of the user's body, and wherein top bladders circumscribing the user's calf are necked and the bottom bladders circumscribing the user's foot are unnecked.

19. A massage device as set forth in claim 18, wherein the garment includes twelve bladders, wherein four of these bladders massage the user's foot and eight of these bladders massage the user's calf.

20. An inflatable garment for use in association with an inflation assembly, the garment comprising a plurality of inflation bladders to apply pressure to a body part, wherein each of the bladders substantially encircles a portion of the body part when in use, at least two of the bladders have different lengths, and wherein the at least two bladders have the same volume.

21. An inflatable garment as set forth in claim 20 wherein, when inflated, each of the bladders apply substantially equal pressure to the body part.

22. An inflatable garment as set forth in claim 20, wherein the garment is made of two opposing sheets and wherein seams between the sheets define the bladders.

23. An inflatable garment as set forth in claim 20, wherein necking seams are positioned relative to one or more bladders to create corresponding necked bladders, wherein the bladders which are not necked bladders are unnecked bladders, and wherein the necking seams substantially equalize the volume of the necked bladders with the unnecked bladders.

24. An inflatable garment as set forth in claim 23, wherein the shape of the necked bladders is substantially similar to the shape of the unnecked bladders.

25. An inflatable garment as set forth in claim 24, wherein the shape of the necked bladders is substantially rectangular.

26. An inflatable garment as set forth in claim 23, wherein the inflatable garment is shaped to accommodate a lower leg portion of a user, and wherein top bladders which when in use encircle a user's calf are necked bladders, and bottom bladders which when in use encircle the user's foot are unnecked bladders.

27. An inflatable garment as set forth in claim 20, wherein the inflatable garment is shaped to accommodate a lower leg portion of a user, and wherein the garment includes a notch on each lateral side which separate the bladders into one or more bottom bladders and one or more top bladders.

28. An inflatable garment as set forth in claim 20, wherein the inflatable garment includes a pocket having one or more opening for communicating with the respective bladders, and wherein the massage device further includes inflation tubing extending from the inflation assembly into the pocket.

29. An inflatable garment as set forth in claim 28, wherein the inflatable garment is shaped to accommodate a lower leg portion of a user, wherein the garment includes a notch on each lateral side which separate the bladders into one or more bottom bladders and one or more top bladders, and wherein the pocket includes on or more slots adjacent one of the notches to provide an entry passage for the inflation tubing into a top portion and a bottom portion of the pocket.

30. A massage device for use in an unsupervised and unattended setting, the massage device comprising:

an inflatable garment having a plurality of inflation bladders to apply pressure to a body part wherein at least some of the bladders have a different length and each of the bladders has approximately the same inflated volume;

an inflation assembly for providing pressurized fluid to the bladders to the respective bladders; and means for equalizing inflation volume of each of the bladders.

31. A massage device as set forth in claim 30 further comprising means for equalizing inflation time of each of the bladders.

32. A massage device as set forth in claim 30 further comprising means for equalizing applied pressure of each of the bladders.

* * * * *